US006102208A

United States Patent [19]

Huang

[11] Patent Number: 6,102,208

[45] Date of Patent: Aug. 15, 2000

[54] DISPOSABLE FRENCH-FRIES ACCOMMODATING CONTAINER ASSEMBLY WITH A FIXED SMALL CONTAINER FOR ACCOMMODATING SEASONINGS AND SAUCE

[76] Inventor: Yao-Chin Huang, No. 99, Fu-Ping St., Nan Dist., Taichung City, Taiwan

[21] Appl. No.: 09/379,992

[22] Filed: Aug. 24, 1999

[51] Int. Cl.[7] ..... B65D 5/4805

[52] U.S. Cl. ..... 206/541; 229/120.18; 229/405; 229/904; 426/120

[58] Field of Search ..... 206/541, 460, 206/806, 813; 229/120.02, 120.18, 120.31, 400, 904, 405; 426/119, 120

[56] References Cited

U.S. PATENT DOCUMENTS 5,137,210 8/1992 Hibbs ..... 229/120.18
5,417,364 5/1995 Shaw ..... 229/904
5,540,333 7/1996 Gonzalez et al. ..... 206/541
5,720,429 2/1998 Cordle ..... 229/904
5,752,597 5/1998 Brangle, Jr. ..... 206/806
5,842,631 12/1998 Berger ..... 229/904

*Primary Examiner*—Paul T. Sewell
*Assistant Examiner*—Luan K. Bui
*Attorney, Agent, or Firm*—Ladas & Parry

[57] ABSTRACT

A disposable french-fries accommodating container assembly includes a large container that has an upper opening and that is adapted to receive French fries, and a small container, which is fixed on an outer surface of the large container and which has an upper opening. The small container is adapted to receive seasonings and sauce.

2 Claims, 9 Drawing Sheets

DISPOSABLE FRENCH-FRIES ACCOMMODATING CONTAINER ASSEMBLY WITH A FIXED SMALL CONTAINER FOR ACCOMMODATING SEASONINGS AND SAUCE

BACKGROUND OF THE INVENTION

1. Field of the Invention

This invention relates to a disposable container that accommodates French fries and that is formed from a single paper sheet by folding and adhering, more particularly to a disposable container assembly, which is provided with a fixed small container for accommodating seasonings and sauce.

2. Description of the Related Art

Referring to FIG. 1, a conventional disposable container 10 is shown to be formed from a single paper sheet. The container 10 has an upper opening 11, and a plurality fold lines 12, 13, 14, along which the container 10 can be folded. Because there is no means for receiving seasonings and sauce in the container 10, a separate container is required for the same, thereby resulting in inconvenience and the likelihood of staining of fabrics, such as clothes or seat covers, by the seasonings and the sauce when eating French fries in the container 10.

SUMMARY OF THE INVENTION

The object of this invention is to provide a disposable French-fries accommodating container assembly with a fixed small container for accommodating seasonings and sauce.

According to this invention, a disposable french-fries accommodating container assembly includes a large container that has an upper opening and that is adapted to receive French fries, and a small container, which is fixed on an outer surface of the large container and which has an upper opening. The small container is adapted to receive seasonings and sauce.

BRIEF DESCRIPTION OF THE DRAWINGS

These and other features and advantages of the invention will become apparent in the following detailed description of the preferred embodiments, with reference to the accompanying drawings, in which.

DETAILED DESCRIPTION OF THE PREFERRED EMBODIMENTS

Figure 1:
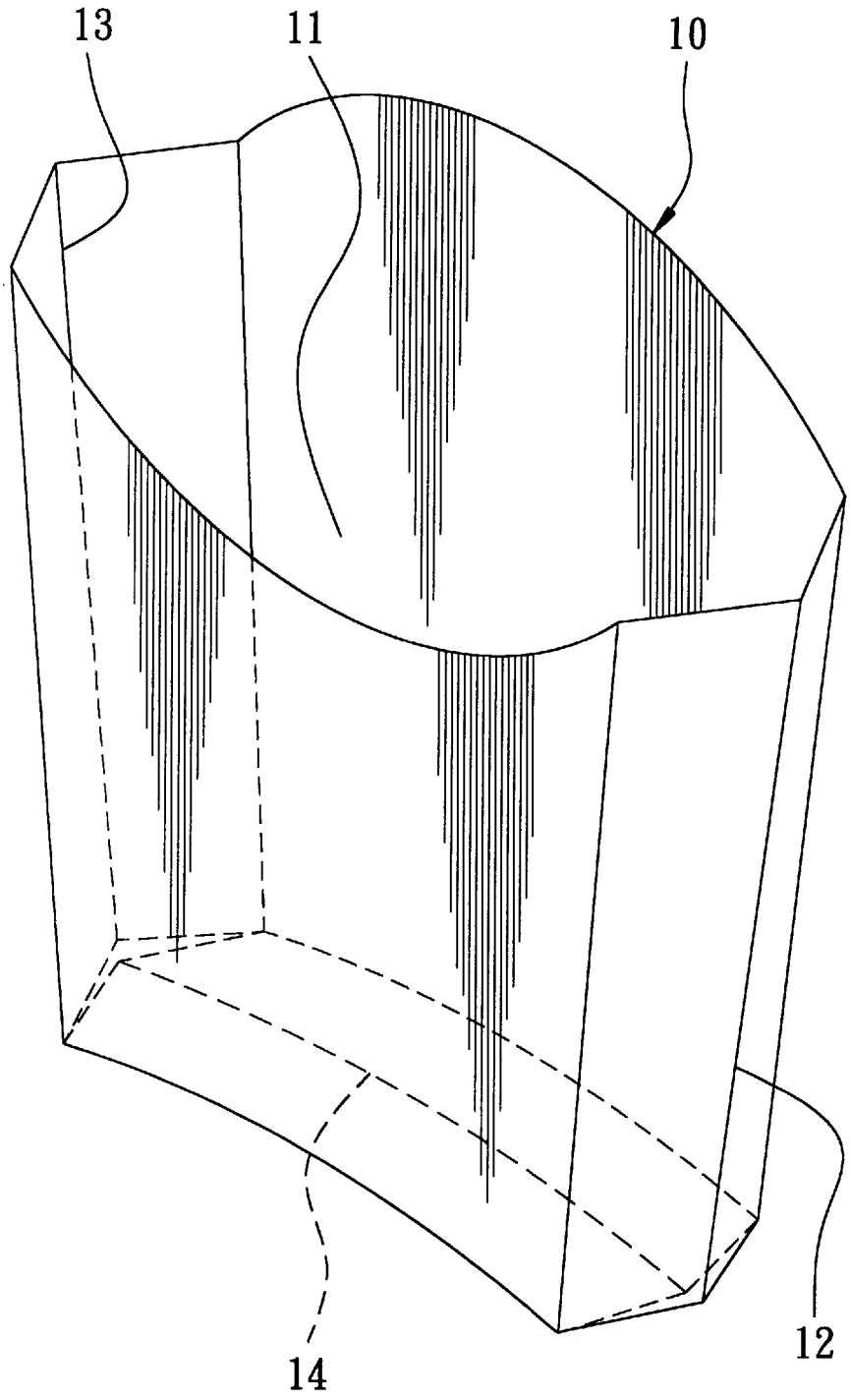
FIG. 1 PRIOR ART
FIG. 1 is a perspective view of a conventional disposable container for accommodating French fries.
Figure 2:
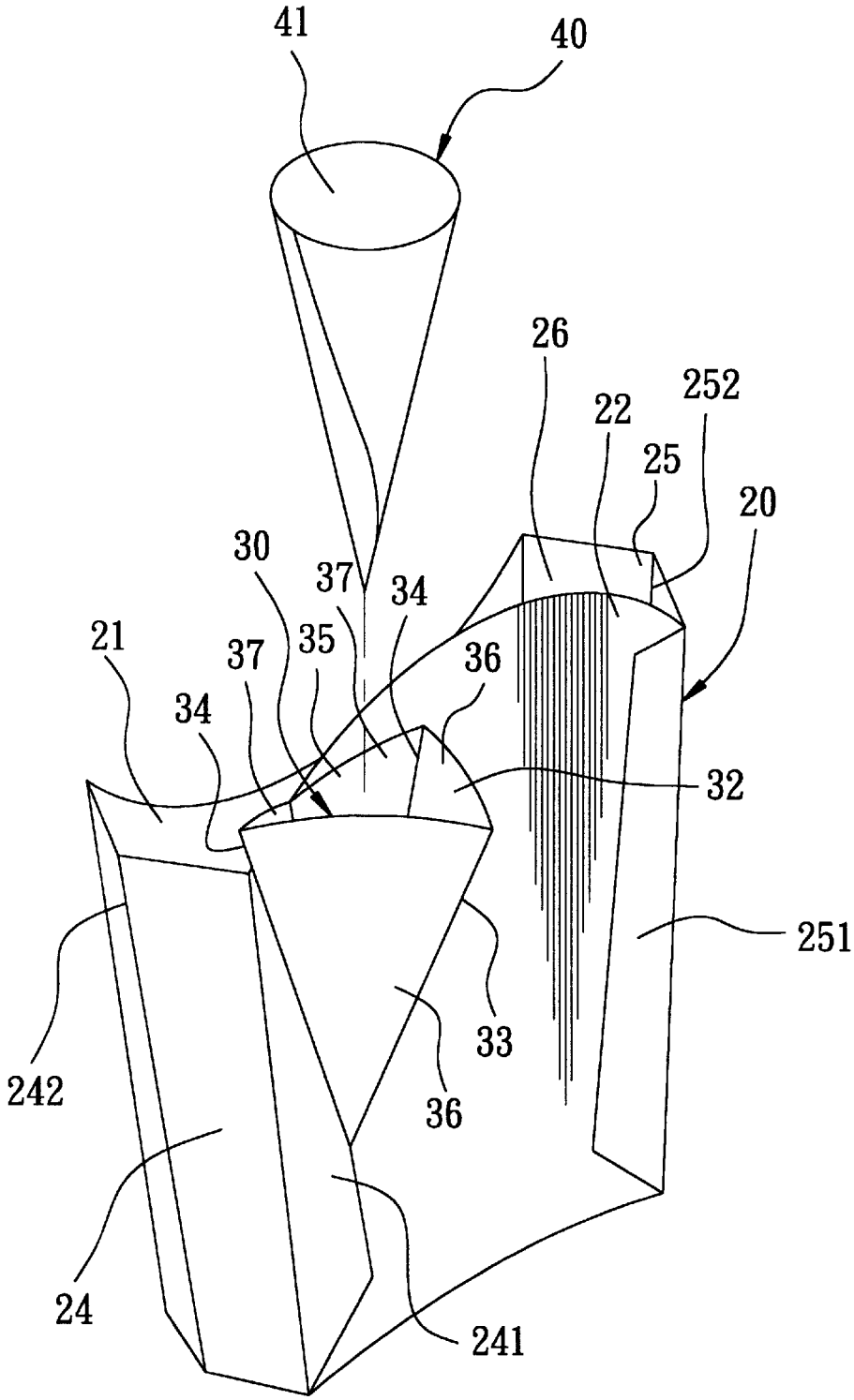
FIG. 2 is an exploded perspective view of a first preferred embodiment of a disposable French-fries accommodating container assembly according to this invention.

Referring to FIG. 2, a first preferred embodiment of a disposable French-fries accommodating container assembly according to this invention is shown to include a large container 20, a small container 30 and a liquid-impermeable plastic container 40, which is shaped as an inverted cone and which has an upper opening 41. The large container 20 has a front wall 21, a rear wall 22, a bottom wall 23, two side walls 24, 25, and an upper opening 26. The small container 30 has a cross-sectional area, which increases gradually from a lower end to an upper end there of. In this embodiment, the small container 30 is shaped as an inverted pyramid, and has an upper opening 35.

Figure 3:
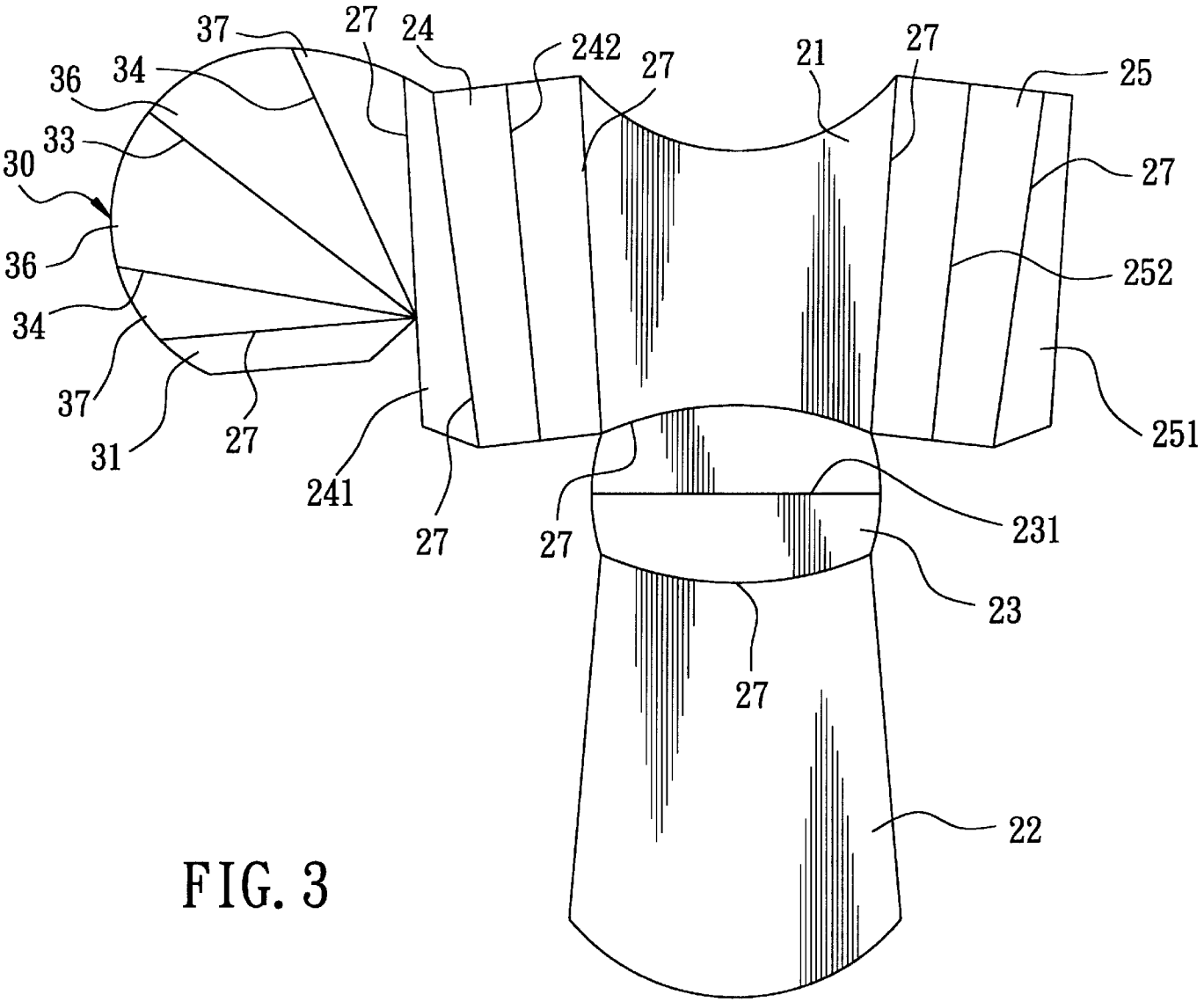
FIG. 3 is a stretched view of a paper sheet, which can be folded to form a large container and a small container of the first preferred embodiment.
Figure 4:
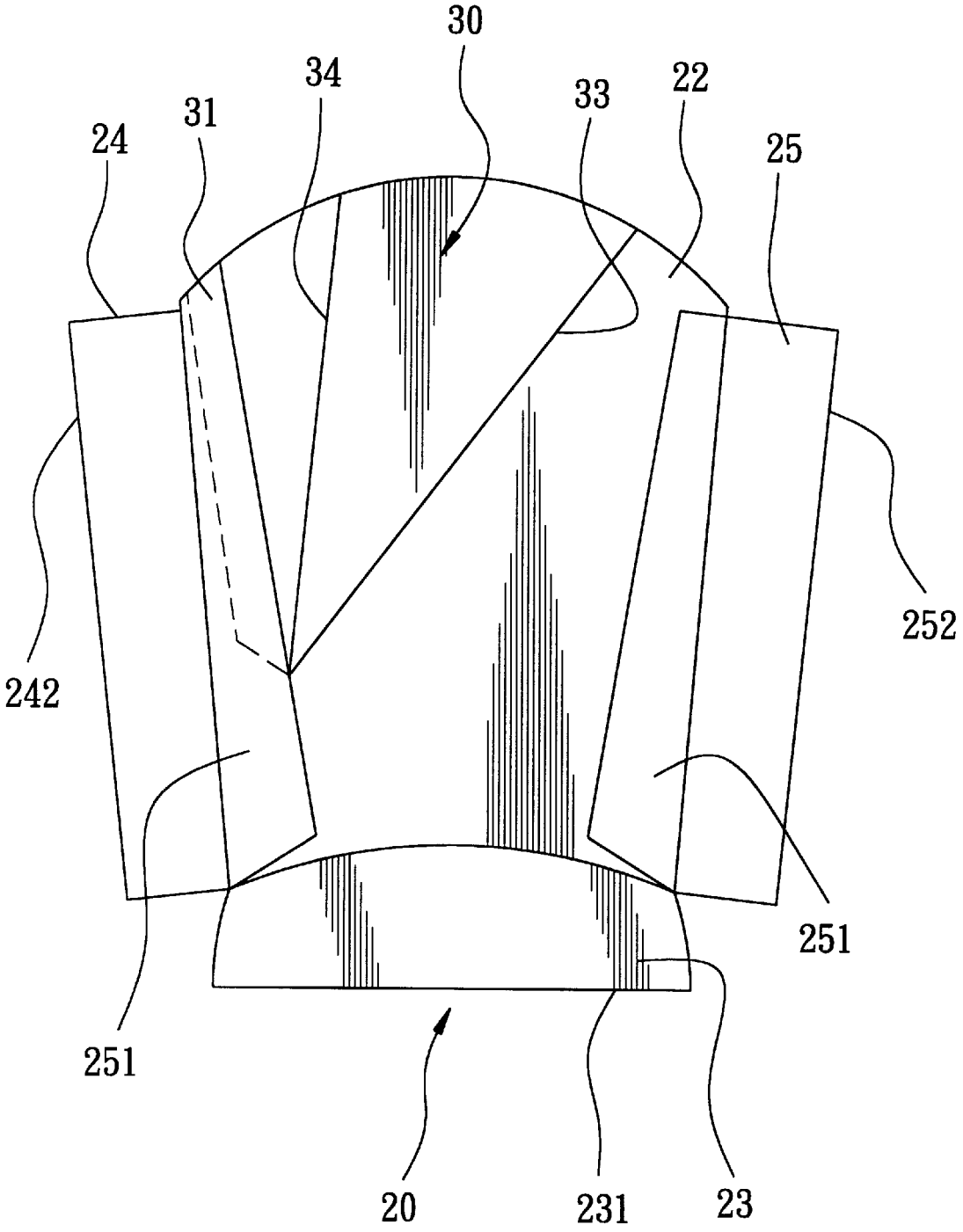
FIG. 4 is a schematic view illustrating how the paper sheet of FIG. 3 is folded along three middle fold lines for transport and storage.

The large and small containers 20, 30 are formed integrally with each other, and are formed from a single paper sheet. Referring to FIG. 3, when stretched, the large container 20 is generally T-shaped. The front and rear walls 21, 22 extend integrally from two opposite sides of the bottom wall 23. The side walls 24, 25 extend integrally from the front wall 21. Two side adhesive strips 241, 251 extend respectively and integrally from the side walls 24, 25, and are adhered to two opposite sides of the back surface of the rear wall 22. The small container 30 extends integrally from one of the side adhesive strips 24, 25. An auxiliary adhesive strip 31 extends integrally from the small container 30, and is adhered to the side adhesive strip 241. The paper sheet has a plurality of bordering fold lines 27. Each adjacent pair of the walls 21, 22, 23, 24, 25, the side adhesive strips 241, 251, the auxiliary strip 31, and the small container 30 are divided by one of the bordering fold lines 27. Each of the bottom wall 23, the side walls 24, 25 and the small container 30 is formed with a middle fold line 231, 242, 252, 33, along which paper sheet can be folded into the structure shown in FIG. 4 for transport and storage. The small container 30 further has two side fold lines 34, which define two inclined portions 36 and two abutment portions 37. Each of the inclined portions 36 is located between the middle fold line 33 and one of the side fold lines 34. One of the abutment portions 37 is located between one of the side fold lines 34 and the auxiliary adhesive strip 31. The other one of the abutment portions 37 is located between the other one of the side fold lines 34 and the side adhesive strip 241. Referring to FIG. 2, the inclined portions 36 are inclined relative to the rear wall 22. The abutment portions 37 abut against the rear wall 22.

Figure 5:
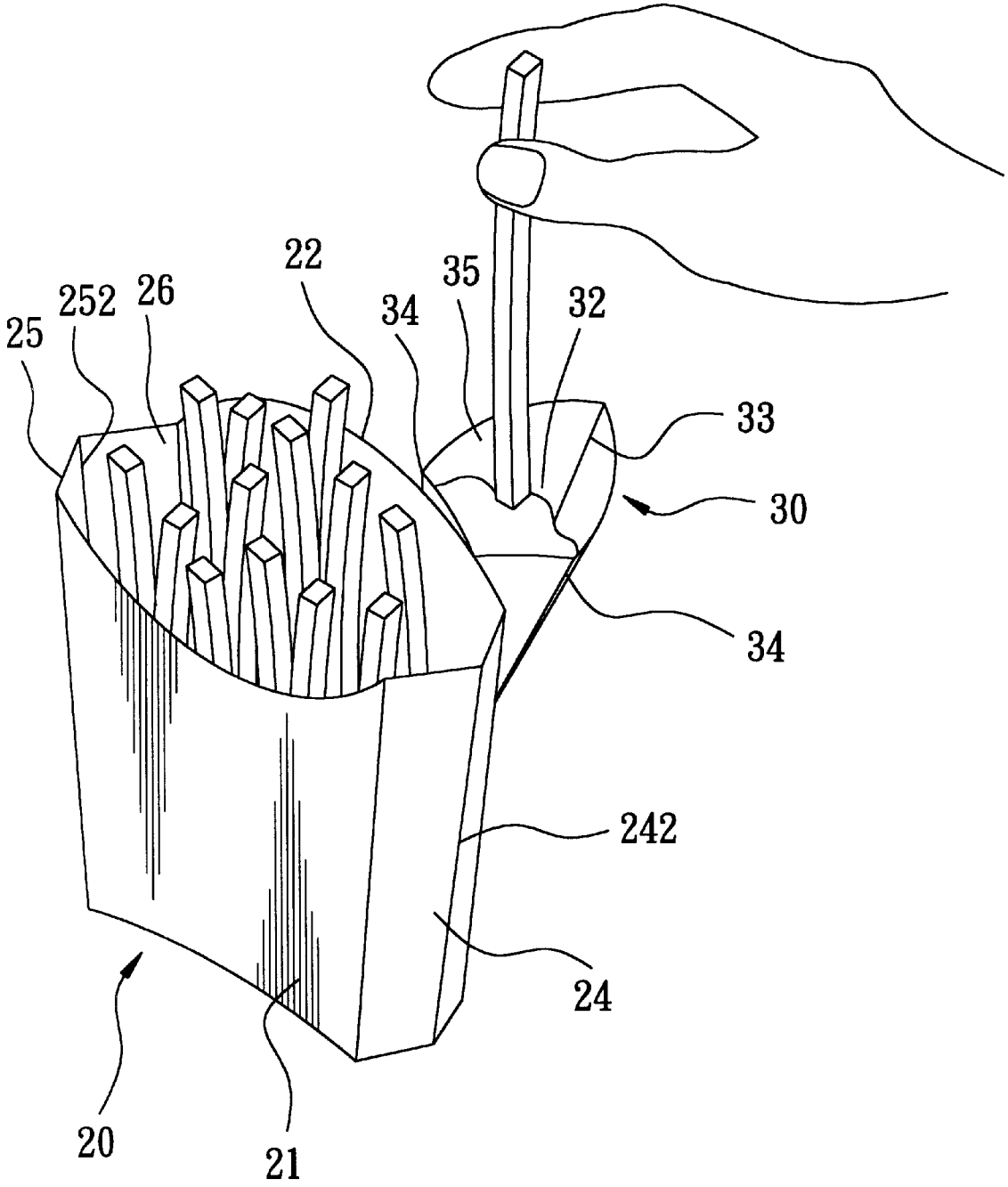
FIG. 5 is a schematic perspective view illustrating the use of the first preferred embodiment, in which sauce is received directly within the small container.

Referring to FIG. 5, in use, French fries are placed within the large container 20. Seasonings or sauce is placed directly within the small container 30.

Figure 6:
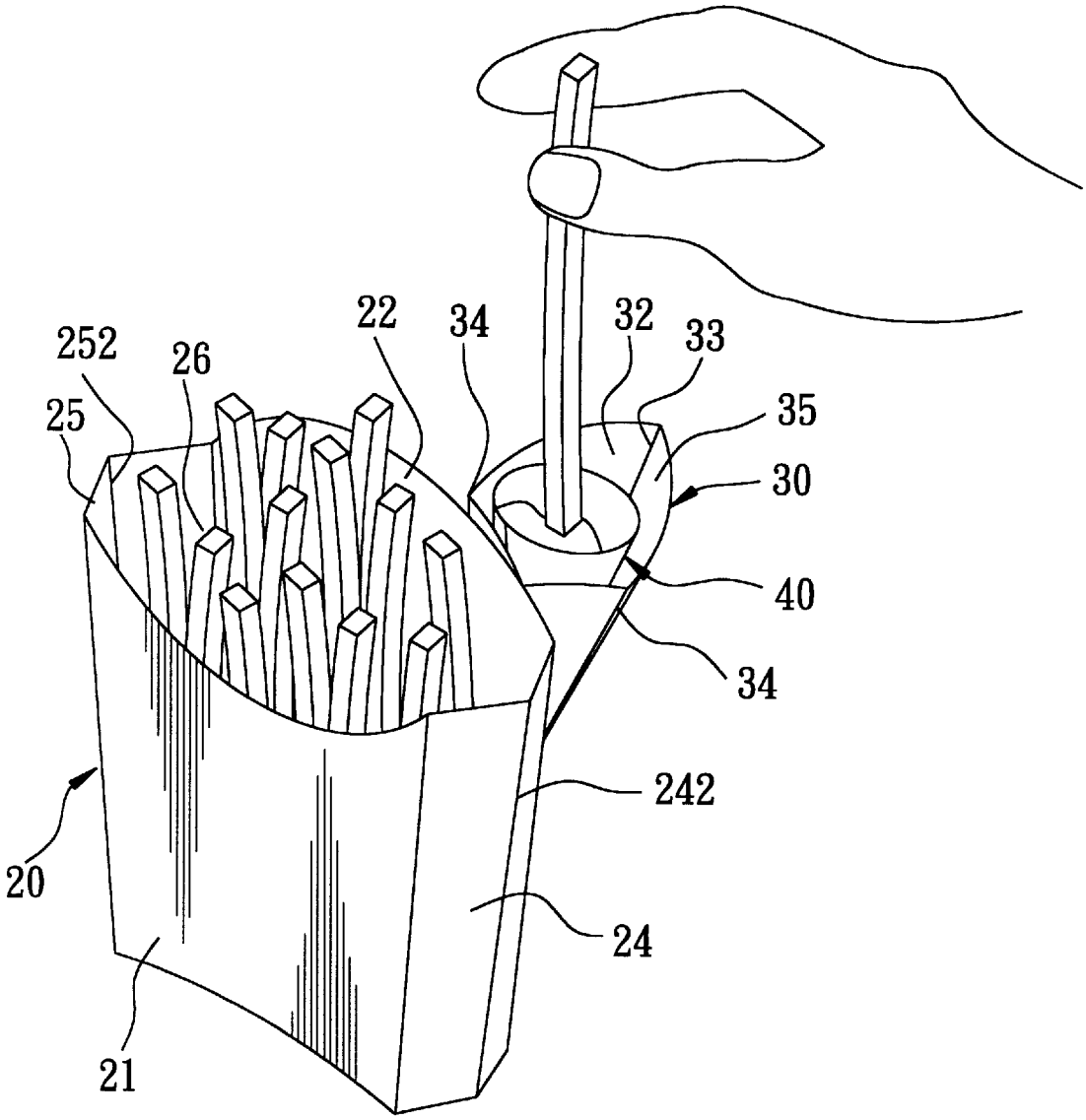
FIG. 6 is a schematic perspective view illustrating the use of the first preferred embodiment, in which sauce is received within an inverted conic plastic container that is placed within the small container.

Referring to FIG. 6, if necessary, seasonings or sauce can be placed within the plastic container 40 that is received within the small container 30.

Figure 7:
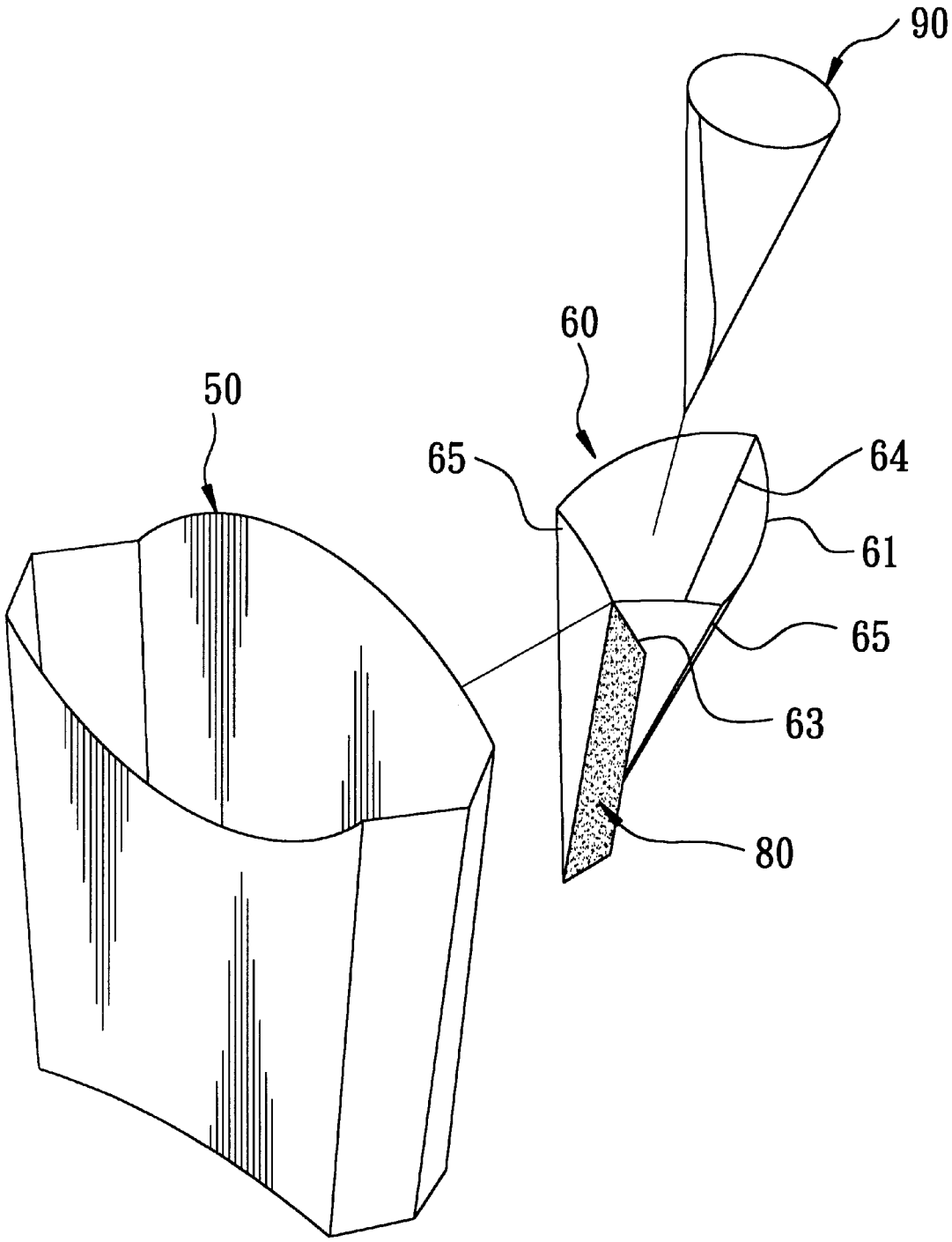
FIG. 7 is an exploded perspective view of a second preferred embodiment of a disposable French-fries accommodating container assembly according to this invention.

FIG. 7 shows a second preferred embodiment of this invention, which includes a large container 50, a small container 60, two spaced double-sided adhesive tapes 70, 80 and a plastic container 90. The large container 50 and the plastic container 90 are similar to the first embodiment in construction. Each of the double-sided adhesive tapes 70, 80 is adhered to both of the large and small containers 50, 60.

Figure 8:
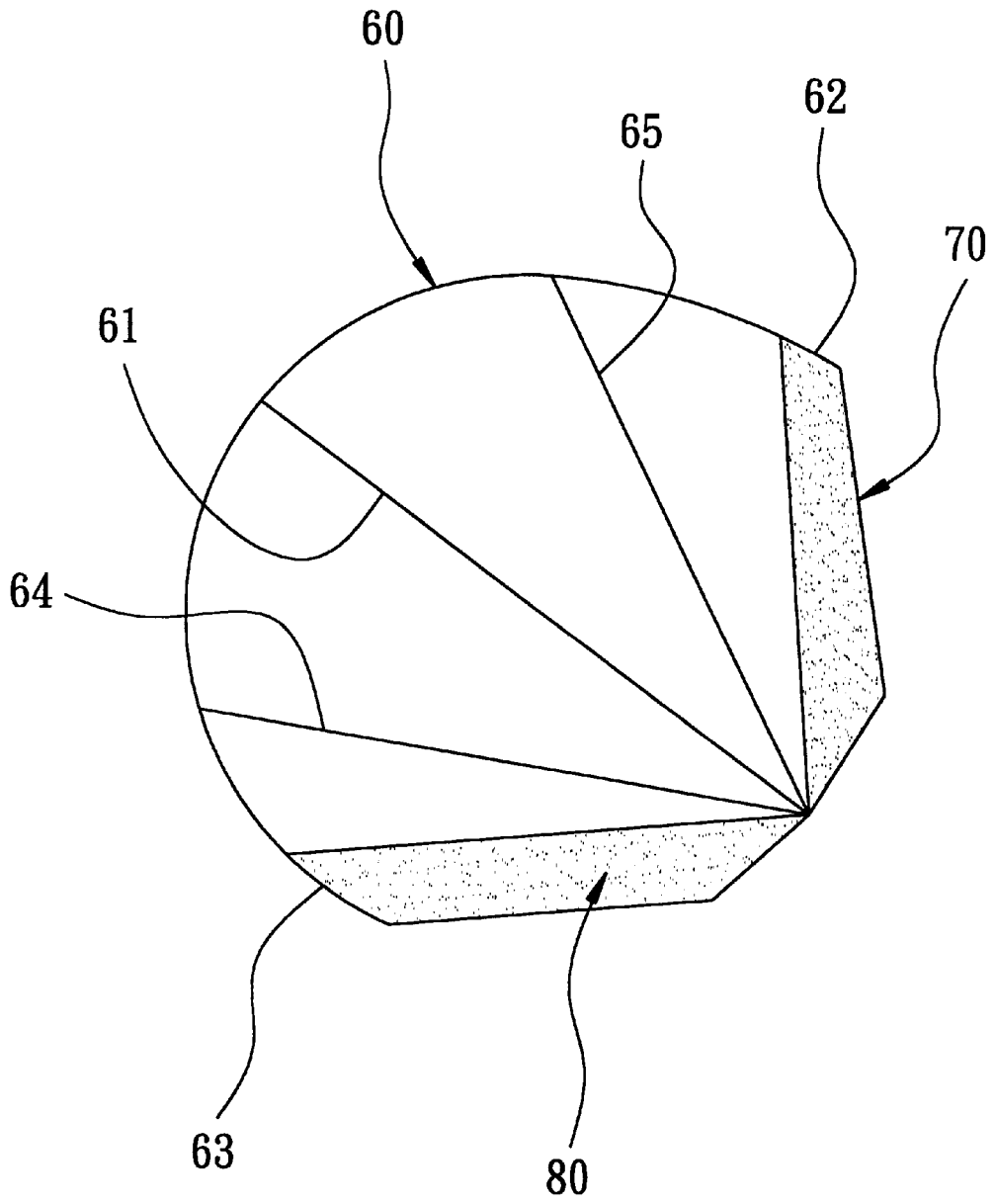
FIG. 8 is a stretched view of a small container of the second preferred embodiment, to which two double-sided adhesive tapes are adhered.

Referring to FIG. 8, the small container 60 is formed from a single paper sheet, which has a middle fold line 61, two auxiliary adhesive strips 62, 63, and two side fold lines 64, 65. The adhesive tapes 70, 80 are adhered to the adhesive strips 62, 63, respectively.

Figure 9:
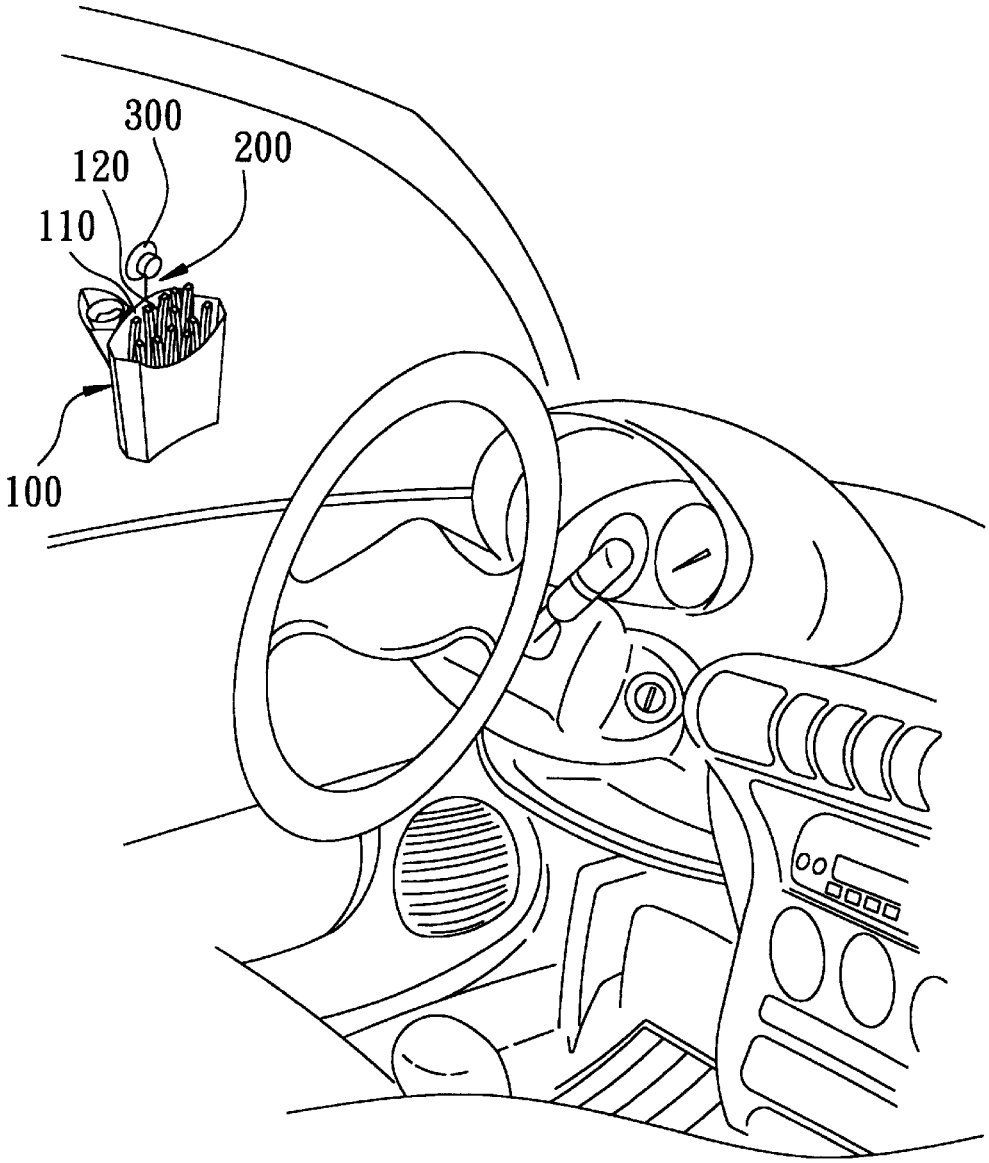
FIG. 9 is a schematic perspective view illustrating how a third preferred embodiment of this invention is used in a car.

Referring to FIG. 9, a third preferred embodiment of a disposable container assembly 100 of this invention is shown to be hung on a window of a car, and includes a large container 110. A rear wall of the large container 110 has a hanging hole 120 formed therethrough. A hook 200 is attached to the window by a suction cup 300, and extends through the hanging hole 120 in the rear wall of the large container 110, thereby hanging the container assembly 100 on the window. With this invention thus explained, it is apparent that numerous modifications and variations can be made without departing from the spirit and scope of this invention. It is therefore intended that this invention be limited only as indicated by the appended claims.

What is claimed is:

1. A disposable french-fries accommodating container assembly comprising a large container that has an upper opening and that is adapted to receive French fries, and a small container, which is fixed on an outer surface of said large container and which has an upper opening, said small container being adapted to receive seasonings and sauce, said large and small containers being formed integrally with each other, and being formed from a single sheet, said large container being generally T-shared when stretched and having a front wall, a rear wall with a back surface, a bottom wall, and two side walls, said front and rear walls extending integrally from two opposite sides of said bottom wall, said side walls extending integrally from two opposite sides of said front wall, two side adhesive strips extending respectively and integrally from said side walls and being adhered to two opposite sides of said back surface of said rear wall, said small container extending integrally from one of said adhesive strips, said container assembly further including a plurality bordering fold lines, and an auxiliary adhesive strip which extends integrally from said small container and which is adhered to said one of said adhesive strips, each adjacent pair of said front wall, said rear wall, said bottom wall, said side walls, said side adhesive strips, and said auxiliary adhesive strip being divided by one of said bordering fold lines.

2. A disposable French-fries accommodating container assembly as claimed in claim 1, wherein each of said bottom wall, said side walls and said small container has a middle fold line, along which said paper sheet is foldable for transport and storage.

* * * * *